US006079117A

United States Patent [19]

Kurschatke

[11] Patent Number: 6,079,117

[45] Date of Patent: Jun. 27, 2000

[54] DEVICE FOR REMOVING MOISTURE FROM TEXTILE WEBS

[75] Inventor: Wolfgang Kurschatke, Krefeld, Germany

[73] Assignee: Eduard Küsters Maschinenfabrik GmbH & Co. KG, Krefeld, Germany

[21] Appl. No.: 09/250,939

[22] Filed: Feb. 18, 1999

[30] Foreign Application Priority Data

Feb. 21, 1998 [DE] Germany ..... 198 07 391

[51] Int. Cl.[7] ..... D06F 58/00

[52] U.S. Cl. ..... 34/115; 34/119; 57/413

[58] Field of Search ..... 34/115, 116, 119, 34/120, 121, 122, 124, 125; 347/41, 42, 71; 57/263, 407, 408, 411, 413; 226/95, 97

[56] References Cited

U.S. PATENT DOCUMENTS

| | | | |
|---|---|---|---|
| 4,718,177 | 1/1988 | Haeszner et al. | 34/119 |
| 5,087,313 | 2/1992 | Duecker | 156/271 |
| 5,174,046 | 12/1992 | Chern | 34/115 |
| 5,438,765 | 8/1995 | Tyrmi et al. | 34/115 X |
| 5,455,992 | 10/1995 | Kurschatke et al. | 26/99 |
| 5,553,392 | 9/1996 | Hannaya | 34/115 |
| 5,647,141 | 7/1997 | Hanaya | 34/115 |
| 5,768,919 | 6/1998 | Kurschatke | 68/170 |
| 5,787,557 | 8/1998 | Kurschatke | 28/165 |
| 5,867,975 | 2/1999 | Breitenhuber et al. | 57/413 |
| 5,917,513 | 6/1999 | Miyauchi et al. | 347/29 |
| 5,974,684 | 11/1999 | Steiner et al. | 34/115 |

FOREIGN PATENT DOCUMENTS

| | | |
|---|---|---|
| 24 03 815 | 8/1975 | Germany . |
| 32 29 004 | 2/1984 | Germany . |
| 42 11 055 | 1/1997 | Germany . |
| 2 102 162 | 6/1982 | United Kingdom . |

*Primary Examiner*—Stephen Gravini
*Attorney, Agent, or Firm*—Kenyon & Kenyon

[57] ABSTRACT

A device for removing moisture from a continuously advancing textile web by suction. A suction slit which reaches crosswise across the textile web is provided, which is delimited on one side by a slide surface, on the other side by a roll. On the side facing the roll, the slide crosspiece has a concave recess, into which the roll partly fits. At its edge, facing the roll, the slide crosspiece forms a tongue-like projection, which extends over the top of the roll, almost to the vertex of the roll.

9 Claims, 1 Drawing Sheet

DEVICE FOR REMOVING MOISTURE FROM TEXTILE WEBS

BACKGROUND OF THE INVENTION

1. Field of the Invention

The present invention relates to a device for removing moisture from a textile web and which reduces friction on the web.

2. Description of the Prior Art

In prior art devices for removing moisture from textile webs, air is drawn into a suction slit, through the permeable textile web, thereby entraining moisture from the textile web, while the textile web is passed over the suction slit in its lengthwise direction. Because of the force caused by this suction, a friction force occurs at the edges of the suction slit, which requires a certain pull in the lengthwise direction of the web in order to bring the web past the suction slit. In order to avoid this pull, it is known from German publication DE-OS 24 03 815 to pass a screen band over the suction slit. The screen band more or less carries the textile web over the suction slit and keeps the forces caused by friction away from the textile web. The rotating screen band in that publication, however, causes additional effort, and takes up space between the adjacent assemblies.

Simpler devices are the object of German Patent 42 11 055 C2, German Patent 32 29 004 A1, and British Patent 2 102 162 A. In these devices, however, the textile web rests on the edges of the suction slit, under the action of friction, and corresponding lengthwise pull forces have to be applied to the web. Such pull forces are not possible, or only are possible with poor results, in the case of some types of textile webs, such as knitted goods.

SUMMARY OF THE INVENTION

The present invention is based on the desire to structure a device for removing moisture from a textile web in a way that the pull force requirements resulting from the friction that occurs at the suction slit are reduced.

In the present invention, the result is that the suction slit is delimited on one side not by a fixed element, at which friction can occur due to the textile web passing by. Instead, in the present invention, the suction slit is delimited by a rotating element which moves in the same direction and at the same speed as the textile web, in the region in which the textile web makes contact with it. Under some circumstances, the roll can even take on a drive and pulling function for the web. The suction slit can be made very narrow, by the interaction of the roll with a correspondingly structured slide crosspiece, so that the textile web cannot be drawn into the suction slit. This function only becomes possible by the interaction of the roll with the slide crosspiece which has a recess, it is not possible by the use of two rolls.

In the preferred embodiment of the present invention, the gap between the circumferential surface of the roll and the opposite delimitation surface of the slide crosspiece widens in a wedge shape away from the suction slit, when viewed in a lengthwise plane of the textile web, perpendicular to the roll. This configuration makes the suction slit the narrowest point of the vacuum path. As a result, the highest flow velocities, and therefore the highest corresponding moisture removal effects, occur at the suction slit.

The slide surface of the slide crosspiece can be smooth and made in one piece, but it can also have a surface relief in the form of ribs, ridges, or depressions which diverge laterally in the movement direction of the textile web. This surface relief acts to spread the textile web out.

In the preferred embodiment of the present invention, the slide surface is horizontal. However, this does not mean that the device cannot be arranged in a different way, for example with a slanted or vertical slide surface.

In order to bring the textile web onto the slide surface securely, in a spread-out state, a rotary stretcher can precede the slide surface. The vertex of the rotary stretcher aligns with the slide surface.

This alignment causes the textile web to be passed over and onto the slide surface in a spread-out state, and therefore prevents the edges from rolling in or for doubling from occurring in the middle. The fact that the vertex of the rotary stretcher aligns with the slide surface and that the rotary stretcher is located as close as possible to the slide surface contributes to this effect.

The present invention can be implemented so that the roll forms a roll nip with a pulling roller located below it, through which the textile web is passed.

The pulling roller may be driven to take the roll along by friction at the circumference. However, it is also possible that the roll itself is driven.

The slide crosspiece can be made of plastic and be produced by extrusion, casting, or milling of a plastic profile.

BRIEF DESCRIPTION OF THE DRAWINGS

The drawing shows an exemplary embodiment of the invention.

DETAILED DESCRIPTION OF THE INVENTION

Figure 1:
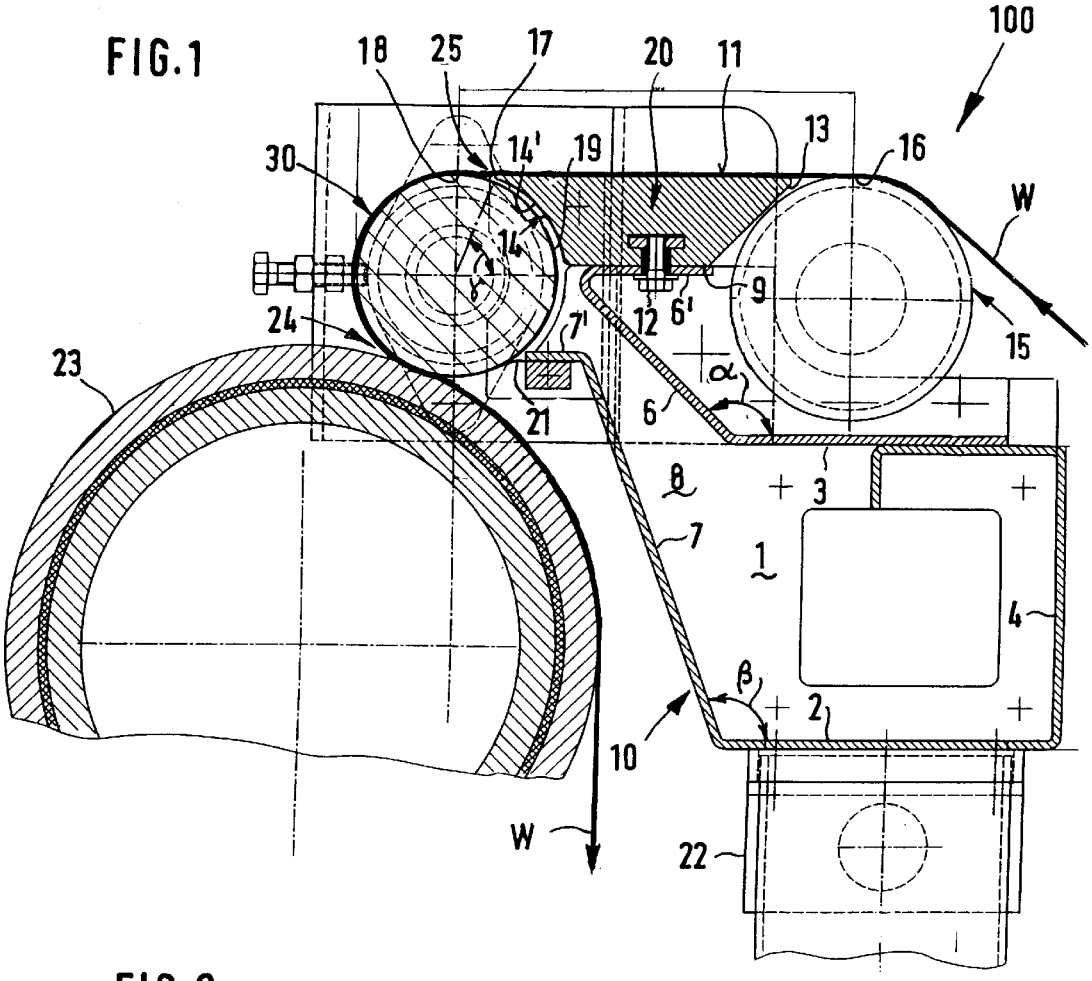
FIG. 1 shows a longitudinal cross-section through the device, perpendicular to the plane of the web.

The device, designated as a whole as 100, includes a horizontal suction crosspiece 10, which extends crosswise relative to textile web W. Crosspiece 10 is made of sheet metal and has a suction chamber 1, which has an approximately square cross-section and a bottom wall 2, an upper wall 3 parallel to it, and a vertical wall 4. There is no wall parallel to and opposite wall 4. Instead, upper wall 3 is bent away toward the top at an angle $\alpha$ of about 45°, to form a wall part 6, and bottom wall 2 is bent away at an angle $\beta$ of about 70° to form a wall part 7, so that a narrowed suction channel 8 is formed between wall parts 6, 7. The outer edges of wall parts 6, 7 lie approximately above one another, and are in turn bent away horizontally. Wall part 6 forms a bent part 6' extending to the back, i.e., towards suction chamber 1, and wall part 7 forms a bent part 7' extending to the outside, i.e., away from suction chamber 1. On bent part 6', a slide crosspiece 20 with an approximately trapezoid cross-section is affixed. In the exemplary embodiment, the slide crosspiece 20 has a longer base side which forms a smooth, flat, horizontal slide surface 11 which is one piece. However, slide surface 11 can also be at a slant, and have a curvature in the movement direction of textile web W. In addition, a surface relief which acts to spread textile web W can be present on slide surface 11. The parallel, shorter surface 9 of slide crosspiece 20 rests on the top of bent part 7', and is attached to bent part 7' by screws 12. Side surface 13 of slide crosspiece 20, which is on the right in the drawing, is slanted, the side surface which is on the left in the drawing is formed by a concave recess 14, which is delimited by a delimitation surface 14' which is circular in cross-section in the exemplary embodiment.

Figure 2:
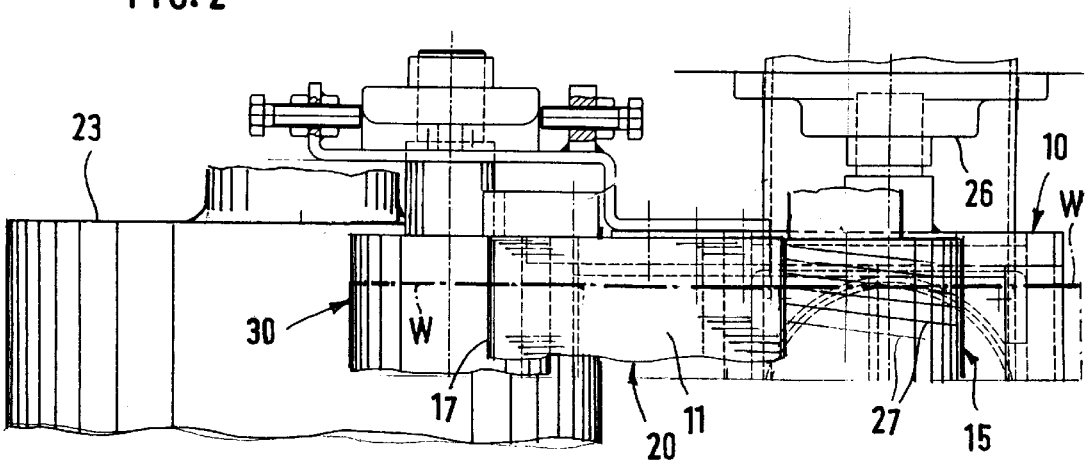
FIG. 2 shows a partial view of the device according to FIG. 1, from the top.

On the right side, partly below slanted side surface 13, a rotary stretcher 15 is provided, the vertex 16 of which aligns with base surface 11 of the cross-section of slide crosspiece 20, i.e. lies at the same height in the arrangement shown. In FIG. 2, rotary stretcher 15 has circumferential ribs 27 which are partially shown in the drawings, which pull textile web W apart in the crosswise direction at a corresponding speed of the circumference of rotary stretcher 15. Textile web W passes over and onto the slide surface 11, which follows practically immediately after stretcher 15, and is perfectly spread out.

On the left side in FIG. 1, a rotating roll 30 is provided, which has a smooth surface, is made in one piece, and partly fits in recess 14. Top edge 17 of recess 14 forms a type of tongue, which reaches almost to vertex 18 of the roll 30, i.e. vertex 18 and slide surface 11 of slide crosspiece 20 lie essentially at the same level. At the same time, top edge 17 of recess 14 forms the front edge of slide surface 11, and, in the exemplary embodiment, lies at an angle $\gamma$ of about 75° in the top right quadrant of the cross-section of roll 30 in FIG. 1. While the circumferential surface of roll 30 and the delimitation surface of recess 14 are both circular and have approximately the same diameter, they are not coaxial. Rather, a suction slit 19 is formed, which widens away from the actual suction slit 25, opening into the suction channel, and its narrowest point is the actual suction slit 25.

Slide crosspiece 20 is tightly connected to bent part 6'. A sealing lamella 21 which is continuous over the width of the textile web W and rests against the circumference of roll 30 is attached at bent piece 7'. Lamella 21 rests against roll 30, counter to its direction of rotation, and seals suction slit 8 relative to roll 30. Therefore, if the vacuum pump connected with tap 22 is put into operation, air can enter into suction chamber 1 from the outside only through suction slit 25.

Underneath roll 30, a pulling roller 23 is arranged, which forms a roll nip 24 with roll 30. At least one of the roll 30 and roller 23 is driven.

Textile web W runs into the device 100 in the direction of the arrow, and passes over rotary stretcher 15. It then passes over slide surface 11 of slide crosspiece 20, which is at the same level as vertex 16 of rotary stretcher 15. Web W then passes from front edge 17 of slide surface 11, after having passed by the very narrow suction slit 25, onto the circumference of roll 30, where a pull takes place in roll nip 24. Textile web W then goes around pulling roller 23 at a looping angle which is about 80° in the exemplary embodiment, and runs out of device 100 to the bottom.

What is claimed is:

1. A device for removing moisture from a continuously advancing textile web by suction, comprising:

a suction chamber;

a slide crosspiece having a slide surface, the slide crosspiece being connected to a wall of the suction chamber;

a rotating roll arranged adjacent to, and parallel with, the slide crosspiece, a vertex of the rotating roll aligning with the slide surface, the slide crosspiece having a concave recess facing the rotating roll, the rotating roll partly extending into the concave recess, an edge of the slide crosspiece adjacent to the slide surface extending over a top of the rotating roll almost to a vertex of the rotating roll;

a suction slit connected to the suction chamber, the suction slit extending across the textile web, the textile web passing over the suction slit, the suction slit having a first edge, the first edge of the suction slit being formed by the slide crosspiece, the suction slit having a second edge, the second edge of the suction slit being formed by the rotating roll.

2. The device of claim 1, further comprising:

a slide seal attached to the suction chamber and extending across a width of the textile web.

3. The device of claim 1, further comprising:

a suction gap connecting the suction slit to the suction chamber, the suction gap widening in a wedge shape between a circumferential surface of the rotating roll and a surface of the concave recess, in a direction away from the suction slit.

4. The device of claim 1, wherein:

the slide surface is smooth and formed in one piece.

5. The device of claim 1, wherein:

the slide surface has a surface relief which acts to spread the textile web.

6. The device of claim 1, wherein:

the slide surface is horizontal.

7. The device of claim 1, further comprising:

a rotary stretcher located ahead of the slide surface, a vertex of the rotary stretcher aligning with the slide surface.

8. The device of claim 1, further comprising:

a pulling roller arranged below the rotating roll, the rotating roll forming a roll nip with the pulling roller, the textile web passing through the roll nip.

9. The device of claim 1, wherein:

the slide crosspiece is made of plastic.

* * * * *